United States Patent [19]

Bennett

[11] Patent Number: 4,914,877

[45] Date of Patent: Apr. 10, 1990

[54] TRANSLUCENT GLASS CURTAIN WALL

[75] Inventor: David J. Bennett, Minneapolis, Minn.

[73] Assignee: Bennett-Ringrose-Wolfsfeld-Jarvis-Gardner, Inc., Minneapolis, Minn.

[21] Appl. No.: 274,700

[22] Filed: Nov. 15, 1988

Related U.S. Application Data

[63] Continuation of Ser. No. 84,574, Aug. 11, 1987, abandoned.

[51] Int. Cl.[4] ..... E04C 2/54; E04B 2/88

[52] U.S. Cl. ..... 52/171; 52/235

[58] Field of Search ..... 52/306, 307, 308, 171, 52/788, 790, 235; 428/34, 38

[56] References Cited

U.S. PATENT DOCUMENTS

| | | | |
|---|---|---|---|
| 543,889 | 8/1895 | Paini . | |
| 737,707 | 9/1903 | Chance | 52/306 |
| 1,991,469 | 2/1935 | Slayter | 52/306 |
| 2,036,021 | 3/1936 | Cheney . | |
| 2,107,994 | 2/1938 | Hazelton | 52/307 |
| 2,117,781 | 8/1938 | McKay . | |
| 2,118,643 | 5/1938 | Fox | 52/307 |
| 2,179,863 | 11/1939 | Rolph | 52/306 |
| 2,194,731 | 3/1940 | Winship | 52/308 |
| 2,216,220 | 10/1940 | Baker | 52/308 |
| 2,306,320 | 12/1942 | Rapp | 52/306 |
| 2,422,837 | 6/1947 | Lenke | 52/307 |
| 2,714,816 | 8/1955 | Pennell | 52/306 |
| 2,768,556 | 10/1956 | Boyd | 52/306 |
| 2,812,691 | 11/1957 | Boyd | 52/308 |
| 2,844,998 | 7/1958 | Vincent | 52/306 |
| 3,183,140 | 5/1965 | Gibson | 428/38 |
| 3,306,956 | 2/1967 | Barnette | 264/1 |
| 3,425,163 | 2/1969 | Horgan | 49/425 |
| 3,442,987 | 6/1969 | Sentementes | 264/1 |
| 3,546,832 | 12/1970 | Smith . | |
| 3,710,074 | 1/1973 | Stewart | 52/171 |
| 4,332,074 | 6/1982 | Auld | 29/527.4 |
| 4,337,590 | 7/1982 | Jackson | 40/615 |
| 4,610,115 | 9/1986 | Thompson | 52/171 |
| 4,610,901 | 9/1986 | Linscott | 428/38 |
| 4,687,687 | 8/1987 | Ternell | 52/171 |

FOREIGN PATENT DOCUMENTS

| | | | |
|---|---|---|---|
| 474725 | 11/1937 | United Kingdom | 52/306 |

*Primary Examiner*—John E. Murtagh

*Attorney, Agent, or Firm*—Merchant, Gould, Smith, Edell, Welter & Schmidt

[57] ABSTRACT

A colored glass curtain wall for a building and a method for constructing the glass curtain wall are disclosed. The colored glass curtain wall comprises a plurality of individual panels interconnected by a support frame. Each individual panel has an inboard sheet and an outboard sheet, both of which are preferably made of glass. At least part of the interior surface of the outboard glass sheet is preferably roughened by either a sandblasting or etching process. The exterior surface of the inboard sheet has a coating of opaque paint corresponding to the roughened portion. A reflective coating may also be applied to either the inboard or outboard sheet.

8 Claims, 2 Drawing Sheets

TRANSLUCENT GLASS CURTAIN WALL

This is a continuation of application Ser. No. 07/084,574, filed Aug. 11, 1987, now abandoned.

FIELD OF THE INVENTION

The present invention relates generally to exterior walls for buildings, and more particularly to glass curtain walls which can be fabricated in a variety of colors.

BACKGROUND OF THE INVENTION

A curtain wall is an exterior wall for a building which serves only as an enclosure element, as opposed to a structural wall which is essential to the building's structure for purposes of bracing or support. Curtain walls must have sufficient stability and stiffness to resist wind, impact and construction handling, as well as sufficient anchorage to the structural frame, especially against lateral forces.

In order to provide a heating insulating curtain wall for the exterior wall of a building, it is common to use two sheets of glass with an insulating air space therebetween. The glass is typically plain clear window glass which is heat-strengthened.

Curtain walls constructed of glass typically consist of a plurality of vision panels and spandrel panels, mounted side-by-side. Vision panels are panes or portions of the curtain wall through which a person inside the building can see. A spandrel panel is one through which a person cannot see from the interior to the exterior; for example, a spandrel panel could be used to cover the building's floor structure, or mechanical components of the structure.

To achieve a colored effect with conventional curtain wall assemblies, colored or tinted glass is sometimes used for either or both of the glass panels. However, only certain metallic admixtures can be added to glass, so that tinted glass can be produced in only a very limited number of colors. As a result, there are only five available colors of tinted glass: green, blue, bronze, gray and rose.

Another alternative to using tinted glass is to coat a surface of one of the glass panels, usually the inside surface of the outside glass sheet, with an opaque paint or a reflective coating. The paint can be applied in any color, unlike the limited palette for tinted glass. However, the resulting painted glass curtain wall tends to have a flat or shallow appearance.

The present invention addresses these and many other problems associated with currently available curtain walls.

SUMMARY OF THE INVENTION

The present invention comprises a glass curtain wall for a building and a method for constructing the glass curtain wall. The glass curtain wall is made of a plurality of individual panels interconnected by a support frame. Each individual panel has an inboard sheet and an outboard sheet, with each panel forming a sealed insulating unit. The panels may be either vision or spandrel panels, depending upon whether a person looking through the panel from the interior of the building is able to see outside.

In the preferred embodiment, both the inboard and outboard sheets are made of glass. According to one aspect of the present invention, the interior surface of the outboard glass sheet is roughened by a sandblasting or etching process. The exterior surface of the inboard sheet has a coating of opaque paint which is viewed through the roughened surface. According to another aspect of the present invention, a reflective coating is applied to either the inboard or outboard sheet. The coatings and roughening treatment can be applied to the various glass surfaces in different combinations, and portions of the panels can be left as clear, untreated glass.

One particular advantage of the glass curtain wall of the present invention is its unique, attractive appearance. The glass curtain wall is capable of being fabricated in an unlimited variety of colors. The panels of the present invention can be designed so as to show bands of color, bands of reflection, and various shapes and designs. Different panels of the glass curtain wall can be given different colors or reflective coatings. Further, aesthetically-pleasing shapes or designs can be fabricated on the various panels according to the teachings of the present invention. In addition, the vision and spandrel panels can be designed to look indistinguishable from each other when viewed from the exterior of the building, producing a uniform, pleasing appearance which still allows persons within the building to see through the vision panels. The combinations and design of the curtain wall panels of the present invention are endless, being limited only by the imagination.

Another feature of the present invention is that the need for colored glass, with its limited range of available colors, is eliminated. Also, the flat, shallow appearance produced by ordinary painted coatings upon the glass is avoided. The glass curtain wall of the present invention has a translucent appearance of depth and quality.

Yet another feature of the present invention is that conventional glass panels can be utilized, so that the labor and cost necessary to produce the above-described visual effect is minimal. Conventional construction techniques such as painting and sandblasting have been combined to produce the unique curtain wall appearance of the present invention.

For a better understanding of the invention, and of the advantages obtained by its use, reference should be had to the drawings and the accompanying descriptive matter in which there are illustrated and described several embodiments of the present invention.

BRIEF DESCRIPTION OF THE DRAWINGS

Referring particularly to the drawings, wherein like reference numerals indicate like parts throughout the several views.

DESCRIPTION OF THE PREFERRED EMBODIMENT

Figure 1:
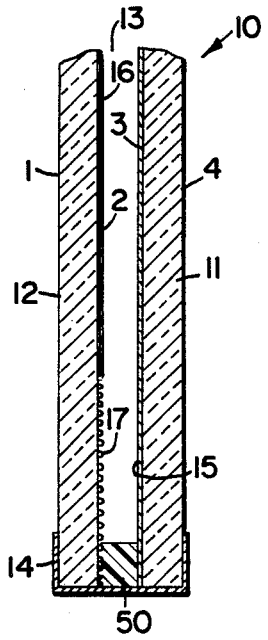
FIG. 1 is a side elevational, cross sectional view of the first embodiment of a spandrel panel of the present invention.

Several embodiments of both spandrel and vision panels are described herein. However, the illustrated embodiments are exemplary only, and many different configurations and combinations could be devised in accordance with the present invention.

The first embodiment of a spandrel panel of the present invention is shown generally at 10. The spandrel panel 10 includes an inboard or interior- sheet 11-.which faces the interior of the building, and an outboard sheet 12 which faces the exterior of the building. Between the interior and exterior sheets 11, 12 is an open air space 13. The inboard and outboard sheets 11, 12 form a sealed insulating unit.

Standard glass panes can be used with the curtain wall of the present invention, and the panes can be of any desired thickness. Factors in determining glass thickness include wind force, the total area of the panes, and how the panes are mounted.

For purposes of discussion, the glazing industry terminology for identifying the glass surfaces will be used. Side 1 is the outside surface of the outside glass sheet; Side 2 is the inside surface of the outside glass sheet; Side 3 is the outside surface of the inside glass sheet; and Side 4 is the inside surface of the inside glass sheet. The identification for the panels 11, 12 used in the glazing industry is labeled on the FIGS. as Sides 1–4.

The sheets 11, 12 of the curtain wall panel 10 are interconnected in a parallel, spaced relationship by a conventional support bracket or frame 14. An interstitial spacer piece 50 is also part of the frame structure 14. The vision and spandrel panels are placed side-by-side within the support assembly 14. The panels are normally approximately five (5) or six (6) feet in either direction, with the sizes of the individual panes being limited by the difficulty of transporting and handling large flexible sheets of glass.

In the embodiment shown in FIG. 1, the exterior sheet 12 is made of ordinary clear glass, and Sides 1 and 4 are left untreated. The inboard sheet 11 of the spandrel panel can be made of any material, such as glass, metal, or any other stable material which can be made to be opaque. In the embodiment shown in FIG. 1, the interior sheet 11 is also made of glass, with its outside surface, Side 3, being coated with an opaque colored paint 15. The paint coating 15 is indicated in FIG. 1 by the parallel diagonal lines. In the preferred embodiment, the paint 15 is a ceramic frit, which is available in an unlimited variety of colors.

Because of the opaque paint 15 on Side 3, it is impossible for someone on the interior of the building looking through the spandrel panel 10 to be able to see to the outside. The viewer would instead see a wall of colored glass. If an opaque wall such as metal were used for the inboard sheet 11 instead of glass, the viewer would of course simply see the opaque wall.

It is to be understood that the paint 15 could also be a reflective coating which, when applied thick enough, would appear to be reflective and opaque from the inside of the building. The extent to which one can see through the reflective coating depends upon the content and density of the reflective coating, as well as how thick it is applied.

On Side 2 of the spandrel panel of FIG. 1, a reflective coating 16 is applied to part of the panel. This reflective coating is indicated by a darkened line. The remainder of Side 2, i.e., the portion of Side 3 which has not been coated with reflective coating, has been mechanically or chemically roughened as shown by the strip 17 of ridges. As shown in FIG. 1, the bottom portion of Side 2 has been roughened, whereas the upper portion has a reflective coating. The relative size and shape of the reflective coating portion 15 and the roughened portion 17 is of course a matter of design choice.

The roughened surface 17 can be achieved by utilizing conventional sandblasting or chemical etching techniques. In the preferred embodiment, a portion 17 of Side 2 has been sandblasted. When the opaque paint 15 is viewed through the roughened surface 17, a translucent, deep appearance is produced. The colored wall 11 appears to be almost three-dimensional or "floating" behind the outer panel 12. The color of the paint 15 when viewed through the roughened surface 17 is also slightly different than if viewed through untreated clear glass. It is to be understood that certain portions of Side 2 could also be left without reflective coating 16 or left unroughened so that the paint 15 would shine directly through the exterior sheet 12 for a different aesthetic effect.

From the inside, the spandrel panel 10 of FIG. 1 would appear opaque, as discussed above. It would be the color of the opaque interior sheet 11, or, if the interior sheet 11 is glass, it would appear to be the color of the opaque paint 15. From the outside, the spandrel panel 10 of FIG. 1 would appear reflective on its upper portion where the reflective coating 16 had been applied, and on its lower portion the panel would have a translucent, deep color. Many combinations of the translucent paint and reflective coating are possible; for example, a panel 10 could have a central rectangular reflective portion bordered on all sides by a translucent colored portion.

In all of the embodiments, the various coatings and roughening treatments are preferably applied before installation of the panels in the curtain wall structure.

Figure 2:
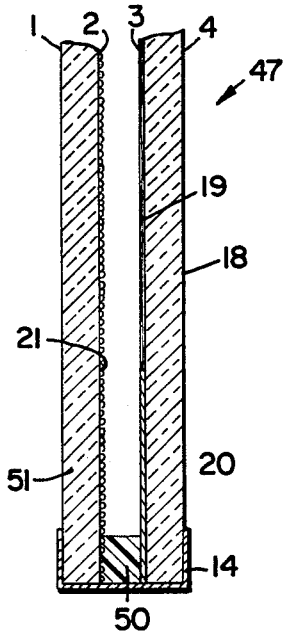
FIG. 2 is a side elevational, cross sectional view of the second embodiment of the spandrel panel of the present invention.

A second embodiment of a spandrel panel of the present invention is shown generally at 47 in FIG. 2. The spandrel panel 17 has an inboard sheet 18 and an outboard sheet 51. With the spandrel panel of FIG. 3, an upper portion of Side 2 of the interior sheet 18 has a reflective coating 19 and a lower portion of the interior sheet 18 on Side 3 has a painted, opaque coating 20. Side 2 of the spandrel panel has a completely roughened surface 21 throughout its entire area. Again, Sides 1 and 4 are left untreated.

In this embodiment, a person viewing the spandrel panel from the inside of the building would not be able to see to the outside (like the first spandrel panel embodiment of FIG. 1). The viewer would see either the opaque inboard sheet 18 itself, or, if the inboard sheet is made of glass, the viewer would see the opaque color of the paint 20 in the lower portion of the panel and a mirror-like surface where the reflective coating 19 was applied to the upper portion of the panel 18. From the exterior of the building, a viewer would see an upper reflective portion 19 and a lower colored portion 20, but the reflective and colored portions 19, 20 would have a deep, translucent quality due to the roughened surface 21 of Side 2.

Figure 5:
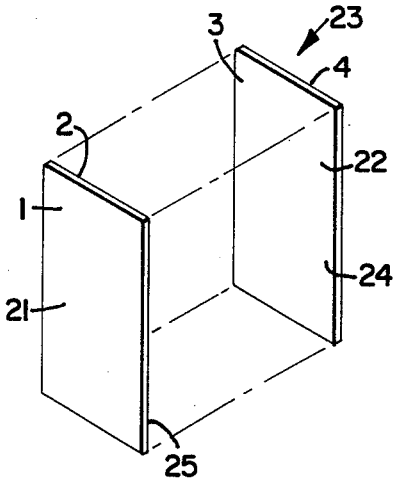
FIG. 5 is an exploded perspective view of the third embodiment of a panel of the present invention.

A third embodiment of a spandrel panel is shown generally at 23 in FIG. 5, this time in perspective view. The third embodiment of the spandrel panel has an exterior sheet 21 and an interior sheet 22. This embodiment is similar to the one shown in FIG. 2, in that Side 2 has been sandblasted or etched over its entire surface to produce a continuous roughened surface 25. Sides 1 and 4 are untreated, clear glass. In this embodiment, Side 3 has been completely coated with a colored paint 24. In the alternative, Side 3 could be completely covered with a reflective coating over its entire surface rather than paint 24.

As can be easily seen, various combinations of the roughened surface, reflective coating, and opaque paint are possible. It is also possible to vary the shape and configuration of the various portions. The designer may also leave portions of Sides 2 or 3 completely uncoated and unroughened for another unique effect.

Figure 3:
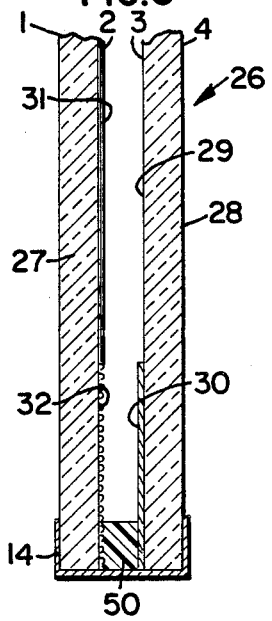
FIG. 3 is a side elevational, cross sectional view of the first embodiment of the vision panel of the present invention.
Figure 6:
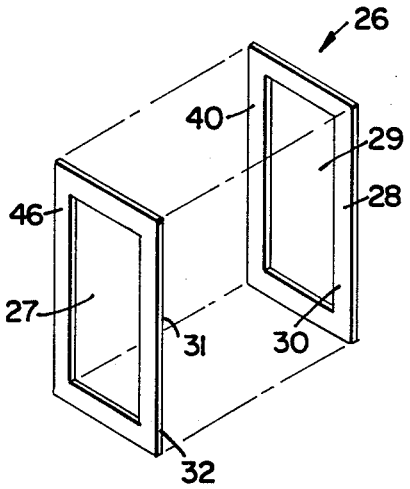
FIG. 6 is an exploded perspective view of a vision panel of the invention.

A first embodiment of a vision panel 26 is illustrated in FIGS. 3 and 6. The vision panel 26 has an exterior sheet 27 and an interior sheet 28, both of which are ordinary clear glass panes. Sides 1 and 4 are left clear and untreated. A central portion 29 of Side 3 is also left completely untreated. The border portion 40 of Side 3 is coated with an opaque paint 30. A reflective coating 31 is applied to the central portion of Side 2 to correspond to the portion of Side 3 which has been left untreated. The border portion 40 of Side 2 has been given a sandblasted finish 32 in the portion of Side 2 which does not have the reflective coating 31. The roughened portion 32 corresponds to the portion of Side 3 which has the paint 30. In this embodiment, a viewer from the interior of the building can see to the outside through the central rectangular portion of the panel 26; that is, the person can see through the clear exterior sheet 28 and through the thin reflective coating 31 on Side 2. However, the person could not see through the border portion 40 of the vision panel 26 because of the opaque paint 30. A viewer from the outside would see a central reflective portion 31 and a colored border portion 40 which had a deep colored appearance, due to the combination of the paint 30 and roughened surface 32.

Figure 4:
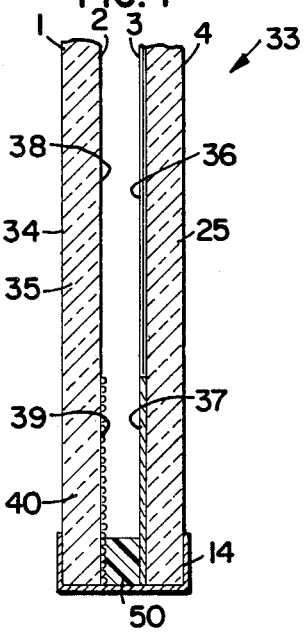
FIG. 4 is a side elevational, cross sectional view of the second embodiment of the vision panel of the present invention.

Another example of a vision panel is shown generally at 33 in FIG. 4. The vision panel 33 has an exterior sheet 34 and an interior sheet 35, both of which are made of clear glass. Sides 1 and 4 are untreated. The upper portion of Side 3 has been given a reflective coating 36 and the lower portion has been painted with an opaque frit 37. Corresponding to the reflective portion 36 on Side 3 is an untreated clear portion 38 on Side 2. The lower portion of Side 2 has been given a roughened finish 39. The roughened surface 39 corresponds to the portion of Side 3 which has an opaque surface 37.

With the latter vision panel, a viewer from the inside can see through the reflective coating 36 and the clear untreated portion of the exterior sheet 34. However, the viewer from the inside cannot see through the opaque paint 37; this portion would appear to be the color of the paint 37. From the exterior, the panel 33 would have a glossy reflective surface 36 in its upper portion, with a colored translucent portion 37 at its bottom or around its border.

Yet another embodiment of a vision panel (not shown) would have a corresponding portion of both the inboard and outboard sheets as clear untreated glass, with a colored border or other portion being produced by the opaque paint/roughened surface combination.

It is to be understood that numerous and various modifications can be readily devised in accordance with the principles of the present invention by those skilled in the art without departing from the spirit and scope of the invention. The present invention could be used to produce a wide variety of glass wall designs for both exterior and interior walls. Therefore, it is not desired to restrict the invention to the particular constructions illustrated and described but to cover all modifications that may fall within the scope of the appended claims.

What is claimed is:

1. A glass curtain wall for a building, comprising:

(a) a plurality of inboard sheets having an inner and an outer surface, wherein at least a portion of said outer surface of said inboard sheets has a coating thereon;

(b) a plurality of outboard sheets made of clear glass, said outboard sheets having an interior and an exterior surface, at least a portion of said interior surface being roughened, wherein said roughened portion of said outboard sheets corresponds to said coated portion of said inboard sheets, wherein said interior surface of said outboard sheet has a reflective coating on the portion of said outboard sheet which has not been roughened; and (c) frame means which interconnect each inboard sheet in a spaced apart and parallel relationship with an outboard sheet so as to form an individual panel, said panels being interconnected side-by-side by said frame means.

2. A glass curtain wall for a building, comprising:

(a) a plurality of inboard sheets having an inner and an outer surface, wherein at least a portion of said outer surface of said inboard sheets has an opaque paint coating thereon;

(b) a plurality of outboard sheets made of clear glass, said outboard sheets having an interior and an exterior surface, at least a portion of said interior surface being roughened, wherein said roughened portion of said outboard sheets corresponds to said coated portion of said inboard sheets, wherein said outer surface of said inboard sheets has a reflective coating on the portion of said inboard sheet which does not have said opaque paint coating; and (c) frame means which interconnect each inboard sheet in a spaced apart and parallel relationship with an outboard sheet so as to form an individual panel, said panels being interconnected side-by-side by said frame means.

3. A glass curtain wall for a building, comprising:

(a) a plurality of glass inboard sheets having an inner and an outer surface, at least a portion of said outer surface having a coating thereon, wherein said entire outer surface of said inboard sheet has an opaque paint coating thereon;

(b) a plurality of glass outboard sheets having an interior and an exterior surface, at least a portion of said interior surface being roughened, wherein said interior surface of said outboard sheet has a reflective coating on the portion of said outboard sheet which has not been roughened; and (c) frame means which interconnect each inboard sheet in a spaced apart and parallel relationship with an outboard sheet so as to form an individual panel, said panels being interconnected side-by-side by said frame means.

4. A glass curtain wall for a building, comprising:

(a) a plurality of glass inboard sheets having an inner and an outer surface;

(b) a plurality of glass outboard sheets having an interior and an exterior surface, wherein a central portion of said inboard sheets and outboard sheets is clear glass being surrounded by a colored border, said colored border being formed by an opaque paint on said interior surface of said outboard sheets and a corresponding roughened portion on said outer surface of said inboard sheets; and (c) frame means which interconnect each inboard sheet in a spaced apart and parallel relationship with an outboard sheet so as to form an individual panel, said panels being interconnected side-by-side by said frame means.

5. A glass curtain wall for a building, comprising:

(a) a plurality of inboard sheets having an inner and an outer surface, wherein at least a portion of said outer surface is roughened;

(b) a plurality of outboard sheets made of clear glass, said outboard sheets having an interior and an exterior surface, at least a portion of said interior surface having a coating thereon, wherein said roughened portion of said interior sheets corresponds to said coated portion of said outboard sheets, wherein said outer surface of said inboard sheet has a reflective coating on the portion of said inboard sheet which has not been roughened; and (c) frame means which interconnected each inboard sheet in a spaced apart and parallel relationship with an outboard sheet so as to form an individual panel, said panels being interconnected side-by-side by said frame means.

6. A glass curtain wall for a building, comprising:

(a) a plurality of inboard sheets having an inner and an outer surface, at least a portion of said outer surface being roughened;

(b) a plurality of outboard sheets made of clear glass, said outboard sheets having an interior and an exterior surface, at least a portion of said interior surface having an opaque paint coating thereon, wherein said roughened portion of said inboard sheets corresponds to said coated portion of said outboard sheets, wherein said interior surface of said outboard sheets has a reflective coating on the portion of said outboard sheet which does not have said opaque paint coating; and (c) frame means which interconnect each inboard sheet in a spaced apart and parallel relationship with an outboard sheet so as to form an individual panel, said panels being interconnected side-by-side by said frame means.

7. A glass curtain wall for a building, comprising:

(a) a plurality of glass inboard sheets having an inner and an outer surface, at least a portion of said outer surface being roughened, wherein said outer surface of said inboard sheet has a reflective coating on the portion of said inboard sheet which has not been roughened;

(b) a plurality of glass outboard sheets having an interior and an exterior surface, wherein said entire interior surface of said outboard sheets has an opaque paint coating thereon; and (c) frame means which interconnect each inboard sheet in a spaced apart and parallel relationship with an outboard sheet so as to form an individual panel, said panels being interconnected side-by-side by said frame means.

8. A glass curtain wall for a building, comprising:

(a) a plurality of glass inboard sheets having an inner and an outer surface;

(b) a plurality of glass outboard sheets having an interior and an exterior surface, wherein a central portion of said inboard sheets and outboard sheets is clear glass being surrounded by a colored border, said colored border being formed by an opaque paint on said outer surface of said inboard sheets and a corresponding roughened portion on said interior surface of said outboards sheets; and (c) frame means which interconnect each inboard sheet in a spaced apart and parallel relationship with an outboard sheet so as to form an individual panel, said panels being interconnected side-by-side by said frame means.

* * * * *

UNITED STATES PATENT AND TRADEMARK OFFICE

CERTIFICATE OF CORRECTION

PATENT NO. : 4,914,877

DATED : Apr. 10, 1990

INVENTOR(S) : David J. Bennett

It is certified that error appears in the above-identified patent and that said Letters Patent is hereby corrected as shown below:

In column 1, line 21, please delete "heating" and substitute therefor --heat--.

In column 2, line 66, add --spandrel-- between the words "a" and "panel."

In column 2, line 68, add --present-- between the words "the" and "invention."

In column 3, line 11, delete "-" between words "interior" and "sheet" and delete "-." between "11" and "which."

In column 4, line 1, delte "Side 3" and substitute --Side 2--.

In column 7, line 23, delete "interconnected" and substitute --interconnect--.

Signed and Sealed this

Fourteenth Day of May, 1991

*Attest:*

HARRY F. MANBECK, JR.

*Attesting Officer*

*Commissioner of Patents and Trademarks*